United States Patent [19]

Duggan

[11] Patent Number: 4,651,140

[45] **Date of Patent: * Mar. 17, 1987**

[54] FIRE DETECTOR

[75] Inventor: Jack Duggan, Willowdale, Canada

[73] Assignee: Fire Detection Devices Ltd., Markham, Canada

[ * ] Notice: The portion of the term of this patent subsequent to May 17, 1999 has been disclaimed.

[21] Appl. No.: 82,957

[22] Filed: Oct. 9, 1979

[51] Int. Cl.[4] ..... G08B 17/04

[52] U.S. Cl. ..... 340/589; 29/512; 337/320; 337/328; 340/593; 340/693

[58] Field of Search ..... 340/593, 589, 693; 337/2, 5, 306, 320, 321, 327, 328; 220/366; 29/512

[56] References Cited

U.S. PATENT DOCUMENTS

| | | | |
|---|---|---|---|
| 1,174,149 | 3/1916 | Himmer Jr. | 337/328 |
| 2,389,429 | 11/1945 | Griffith | 340/593 X |
| 2,413,140 | 12/1946 | Griffith | 337/320 X |
| 2,779,998 | 2/1957 | Bailey | 29/512 |
| 3,098,286 | 7/1963 | Anderson et al. | 29/512 |
| 3,188,434 | 6/1965 | Numayama | 337/328 X |
| 3,303,308 | 2/1967 | Koopman | 337/320 X |
| 3,406,556 | 10/1968 | Musser | 29/512 X |
| 3,827,012 | 7/1974 | Duggan | 337/320 |
| 4,116,357 | 9/1978 | Stanley Jr. | 220/366 X |

FOREIGN PATENT DOCUMENTS

| | | | |
|---|---|---|---|
| 753714 | 2/1967 | Canada | 337/5 |
| 101145 | 11/1962 | Norway | 340/593 |

*Primary Examiner*—Glen R. Swann, III

*Attorney, Agent, or Firm*—Ivor M. Hughes

[57] ABSTRACT

An improved fire detector vented to atmosphere, capable of closing or opening an alarm circuit on the happening of either two events, when the rate of rise of the temperature of the ambient atmosphere exceeds a predetermined prescribed rate of rise of temperature and when the temperature of the ambient atmosphere exceeds a predetermined fixed temperature, the detector being of the type comprising a base supporting a diaphragm enclosing a space between the base and diaphragm, a shell secured to the base enclosing the diaphragm, vent apertures through the base from the space between the diaphragm and shell, and between the diaphragm and base, to the back of the detector, and a fin for collecting heat from the ambient atmosphere. The vent aperture permits the spaces between the diaphragm and base, and shell and base to be vented to atmosphere under normal expansion and contraction of the ambient atmosphere. The fin is connected by a blind hole ferrule which is closed by an end face and supports a detente member for actuating an alarm at a predetermined temperature. The connection between the fin and ferrule is formed by causing metal from the end face of the ferrule to flow over fin metal surrounding the aperture of the fin through which aperture the ferrule extends.

29 Claims, 19 Drawing Figures

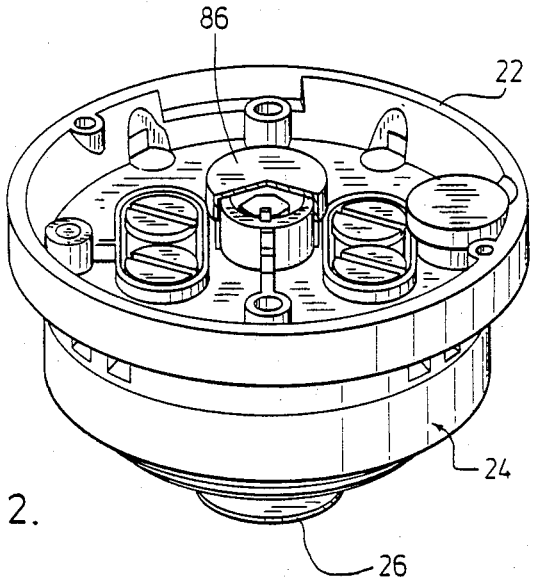
FIG. 2.
FIG. 1.
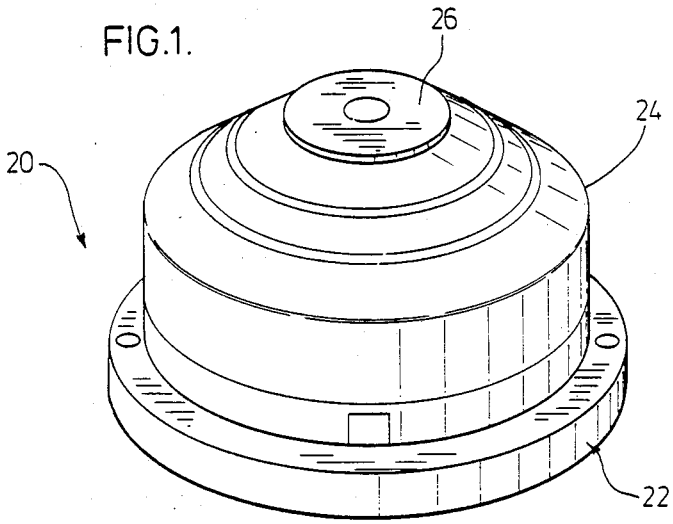

FIRE DETECTOR

FIELD OF INVENTION

This invention relates to improvements in fire detectors and structural components therefor.

BACKGROUND OF THE INVENTION

Fire detector devices may be designed to actuate an alarm by closing or opening a circuit on the happening of either one, or both, of two events—when the rate of rise of the temperature of the ambient atmosphere exceeds a predetermined prescribed standard, for example, the 15F° per minute standard set by Underwriter Laboratories of Canada and Underwriter Laboratories Inc. of the United States, and/or when the ambient temperature exceeds a predetermined fixed temperature.

These detectors must also operate in all environmental conditions, for example, extremes of humidity, variations of heat and cold, and acidic or alkaline vapour mediums.

The necessity for such operation has been recognized by various Governmental and independent examining bodies, and standards have been set which the devices must meet or exceed. One such body is the Fire Insurer' Research and Testing Organization (FIRTO for short) of the United Kingdom, who as part of its testing program, has prescribed that such fire detectors must pass a sulphuric acid environment test. This test requires that the fire detector sit in a sulphuric acid environment for a predetermined time and thereafter, still be operable. However, no fire detector that vents to the atmosphere tested with the rate of rise feature has remained operable after the time period spent in the sulphuric acid vapour medium. The reason lies in the construction of the vented detector incorporating the rate of rise feature. The chamber between the shell and diaphragm and diaphragm and base must be vented to atmosphere to permit normal atmospheric expansion due to temperature fluctuations without actuating the alarm.

The vent apertures if left unprotected in the acidic environment, permit the acidic environment to be drawn into the chambers when the detector is breathing during normal temperature fluctuations, corroding the electrical contacts.

Surrounding the vents with a wall and covering the wall created with a closure cap, providing a small vent hole in the cap wall or between the cap and wall only accentuates the problems of corrosion. The small vent hole, it is thought, acts as a pump drawing in and exhausting substantial amounts of acidic vapour through the small vent hole and permits condensation of the vapour, thereby trapping the liquid acid in the contact area.

Additionally, during the tests, some heat collecting fins on certain fire detectors were also attacked by the corrosive vapour and lost their temperature sensitivity due to the formation of a residue on the fin as a result of the reaction between the metal fin and fusible link (if exposed—holding the plunger), and the sulphuric acid vapour.

Where the fin and ferrule were combined in one piece, in the detector, the fin was not only attacked by the vapour, but the fin could not be manufactured of a large diameter at reasonable cost. However, it is desirable to manufacture fins of large diameter for enhanced temperature sensitivity. Where attempts have been made to make the fin-furrel combination from two components, with the fin of large diameter, the union has not yielded a satisfactory result. Particularly, where the two pieces are to be joined, they must be "married" to effect maximum metal contact at the joint for effective heat transfer between the components, to the fusible link.

It is therefore, an object of this invention to provide an improved fire detector and structural components useful therefor.

It is a further object of this invention to provide an improved fire detector vented to atmosphere having a rate of rise feature suitable for use in an acidic vapour medium.

It is a further object of the invention to provide an improved detector having an improved heat fin for the collection and effective transfer of heat to the fusible link holding the plunger for release at a fixed predetermined temperature (the fusion temperature of the fusible link).

Further and other objects of the invention will be realized by those skilled in the art from the following summary of the invention and detailed description of preferred embodiments thereof.

SUMMARY OF THE INVENTION

Unexpectedly, according to one aspect of the invention, an improved fire detector vented to atmosphere, capable of closing or opening an alarm circuit when the rate of rise of the temperature of the ambient atmosphere exceeds a predetermined prescribed rate of rise of temperature is provided comprising a base supporting a diaphragm enclosing a space between the base and diaphragm, a shell secured to the base enclosing a space between the diaphragm and shell, electrical circuit contacts mounted on the base for being closed or opened when the actual rate of rise of the temperature of the atmosphere in the space between the diaphragm and shell exceeds a predetermined rate of rise of temperature, vent apertures through the base from the spaces between the diaphragm and shell and between the diaphragm and base to the back of the detector, the improvement comprising the vent apertures each being surrounded by an endless wall covered by a closure cap having a top and depending skirt, small projections disposed between the top of the closure cap and the top of the endless wall and thin posts or lugs between the endless wall and depending skirt for spacing the top of the wall from the top of the closure cap and spacing the endless wall from the depending skirt, (preferably, the wall including the relatively small projections on the top and the relatively thin posts or lugs extending from the side to enable the closure cap to seat on the small projections on the top of the wall and of an inner diameter to snugly seat the depending skirt of the closure cap against the outer surface of the posts or lugs) to cover the vent aperture permitting the spaces between the diaphragm and base and shell and base to be vented to atmosphere under normal expansion and contraction of the ambient atmosphere in the fire detector without drawing substantial amounts of air from outside the cover and wall through the vent apertures.

According to another apsect of the invention, the projections on the top of the wall may number at least three, and the posts or lugs may number at least three.

According to another aspect of the invention, the projections on the top of the wall may extend about 1/32" (about 8/10 mm.) above the top of the wall.

According to another aspect of the invention, the posts or lugs may project about 40/1000" (about 1 mm.) from the wall and may be about 3/32" (about 2 4/10 mm.) wide.

According to another aspect of the invention, an improved fire detector is provided having alarm actuating means for actuating an alarm at a predetermined temperature and a fin for collecting heat from the ambient atmosphere, the improvement comprising the fin being connected by a ferrule to alarm actuating means for actuating an alarm at a predetermined temperature, the connection between the fin and ferrule having been formed by causing metal in an end portion of the ferrule to flow over the fin metal surrounding the aperture of the fin through which aperture the ferrule extends to provide a thin layer of ferrule metal over fin metal.

This connection is accomplished by choosing a ferrule of a configuration according to the method of union of the ferrule and fin to preclude the ferrule from collapsing under the forces applied by such method to cause the ferrule metal to flow radially to form the union between the fin and ferrule. For example, where a blind hole ferrule having a closed end is to be secured to a fin by the wobble method-the end of a riveting peen rotates around a circle at for example, the approximate rate of 1000 r.p.m. on the face of the end of the ferrule to cause ferrule metal to flow radially outwardly over the fin metal adjacent the central aperture of the fin according to a circular path around the centre of the ferrule—the ferrule has a concave face supported behind and by a mandrel in the blind hole to resist collapsing while the metal in the concave face flows radially over the fin. Similarly, when using a punch press or vertical press the face of the blind hold ferrule is concave. Where the ferrule is open holed, the ferrule is supported (including a mandrel positioned in the open hole) and may be cold swaged and caused to flow radilly over fin metal to join the two employing the above methods. Preferably, this connection of a blind hole, or open hole ferrule, to a fin is accomplished by a rolling action of a riveting peen in a cycloidal motion (describing a series of loops that overlap tangentially at the centre to give overall a rosette pattern) against the end portion of the supported ferrule to cause such metal to flow outwardly to intimately engage the fin metal adjacent the aperture. The BRACKER RADIAL (t.m.) Riveting Machine, Models RN002, RN102, RN211, and RN311 manufactured by Bracker A.G., CH8330 Pfaffiken-Zurich, Switzerland, actuates the riveting peen to describe the said motion in rolling the metal of the ferrule into intimate contact with the fin metal adjacent the center aperture. Particularly, the very light axial force exerted by the machine on the peen and rolling action of the peen, causes the metal to flow mainly in the radial direction, virtually freeing the ferrule from stress.

As a result, the metal of the ferrule is married to the metal of the fin. In this way, an anodized aluminum fin of relatively large diameter (and thus nonsolderable, but immune to sulphuric acid) may be intimately connected to a solderable blind hole tin plated aluminum furrel which in turn holds the fusible link of a detente in the blind hole out of contact with the ambient atmosphere. Therefore, the resultant detector is unaffected by a sulphuric acid vapour environment.

According to another aspect of the invention, the fin may be corrugated to agitate the air passing over the fin causing turbulence thereby presenting more heated ambient air in contact with the fin, for more effective heat transfer.

For rolling the ferrule with the open hole to the fin, stepped or riveting peen having a flat central portion of substantially the same inner diameter as the aperture in the ferrule extends into the hole of the ferrule and includes flat side portions stepped from the flat central portion for engaging the end portions of the ferrule to be rolled.

In the case of the ferrule with the blind hole, the tool is flat and is greater in diameter than the ferrule, to roll the ferrule adjacent the blind hole into intimate contact with the fin material.

The invention will now be illustrated with reference to the following drawings of preferred embodiments of the invention, and detailed descriptions thereof.

BRIEF DESCRIPTION OF THE DRAWINGS

FIG. 1 is a perspective view of a fire detector operating to actuate an alarm, when the rate of rise of the temperature of the ambient air exceeds a predetermined prescribed rate and, when the ambient temperature exceeds a predetermined fixed temperature, according to a preferred embodiment of the invention;

FIG. 2 is a top perspective view of the detector of FIG. 1 partly cut away;

DETAILED DESCRIPTION OF PREFERRED EMBODIMENTS OF THE INVENTION

Figure 3:
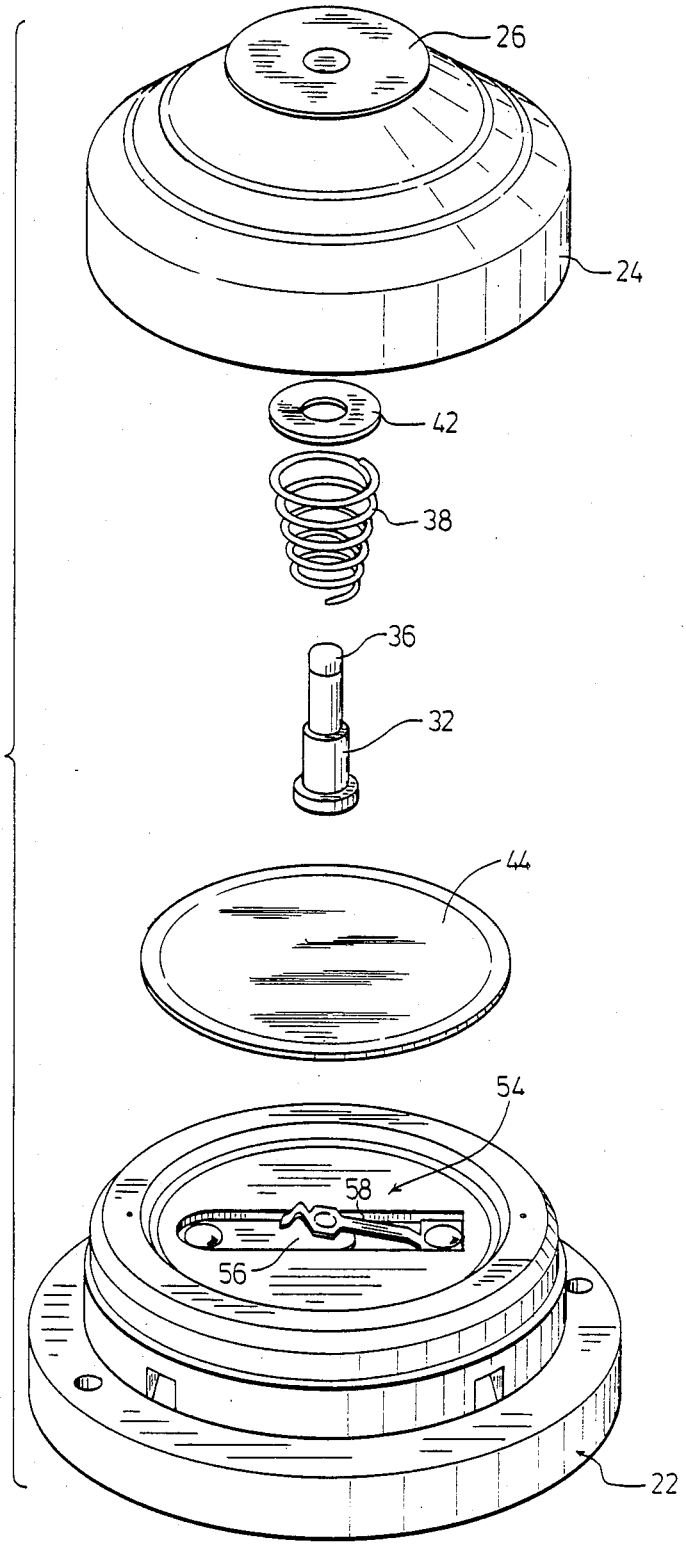
FIG. 3 is an exploded view of part of the detector shown in FIGS. 1 and 2.
Figure 4:
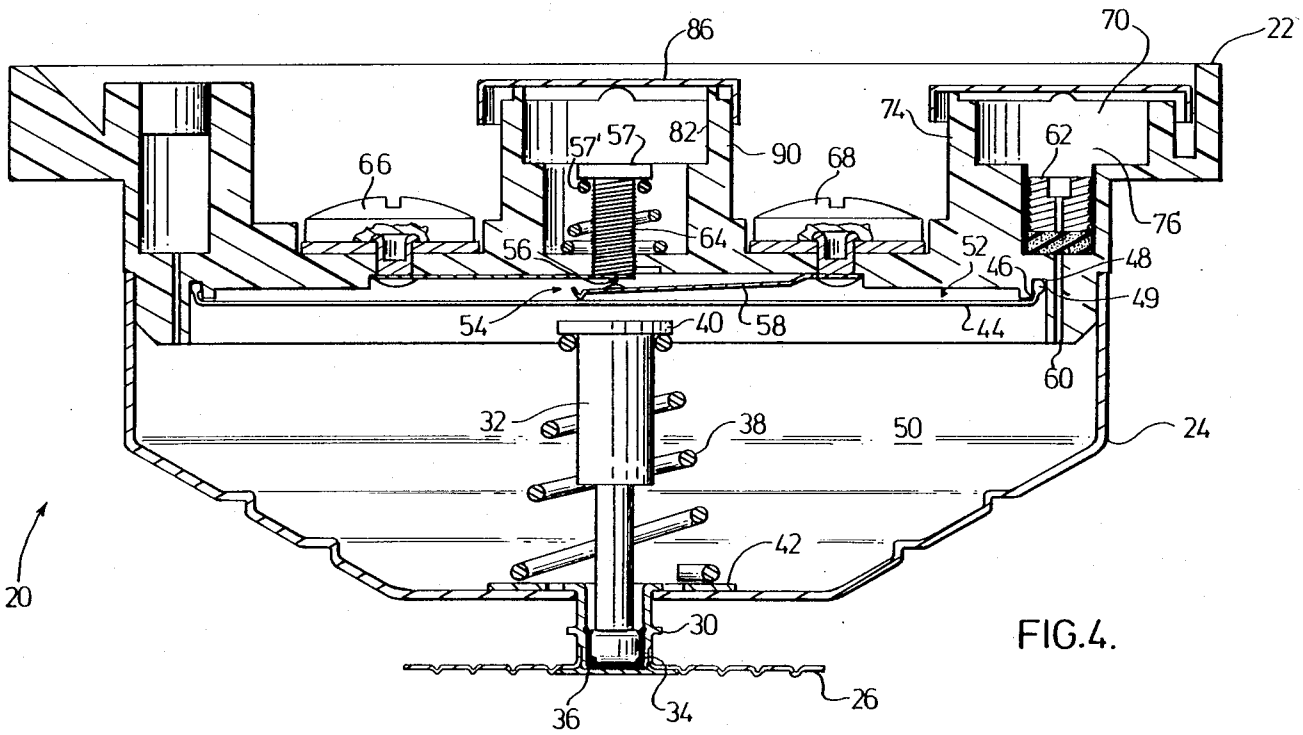
FIG. 4 is a vertical cross-sectional view of the detector shown in FIGS. 1, 2 and 3.

With reference to FIG. 1, there is shown a fire detector 20, comprising base 22, and outer cup-shaped shell 24 carrying annular heat collecting fin 26. Both shell 24 and fin 26 are made of anodized aluminum. Fin 26 is also corrugated having spaced concentric annular ridges 28 (See FIGS. 16 and 19). Fin 26 is positioned with respect to shell 24 by tin plated aluminum ferrule 30 extending through central aperture (not shown) in the center of shell 24. Ferrule 30 supports detente member 32 (see FIGS. 3 and 4) in blind bore 34 of ferrule 30 by fusible link 36 which fuses at a predetermined temperature. Detente member 32 supports tapered compression spring 38, tapering in a direction away from fin 26, for being compressed by flange 40 of detente member 32 when assembled in shell 24. The other end of compression spring 38 rests on gasket 42 sitting on shell 24.

Figure 5:
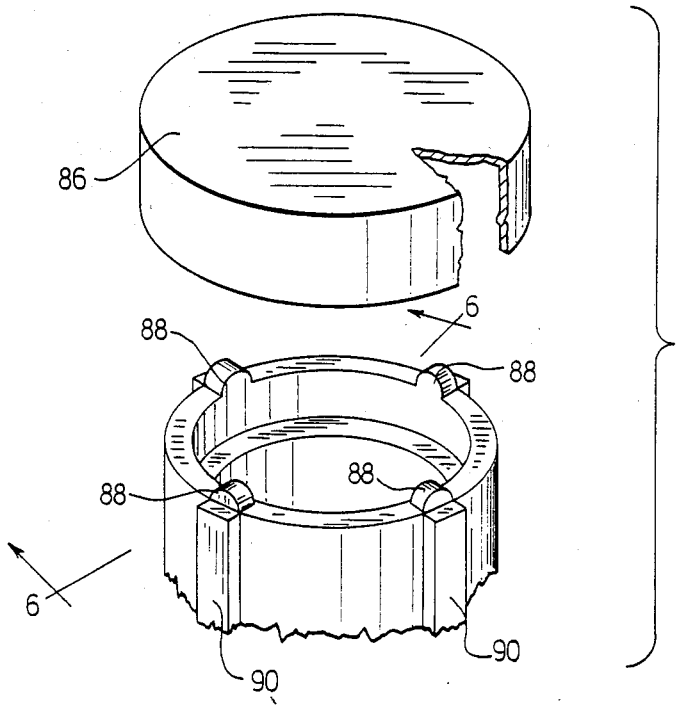
FIG. 5 is an exploded view of part of the structure shown in FIGS. 2 and 4.
Figure 6:
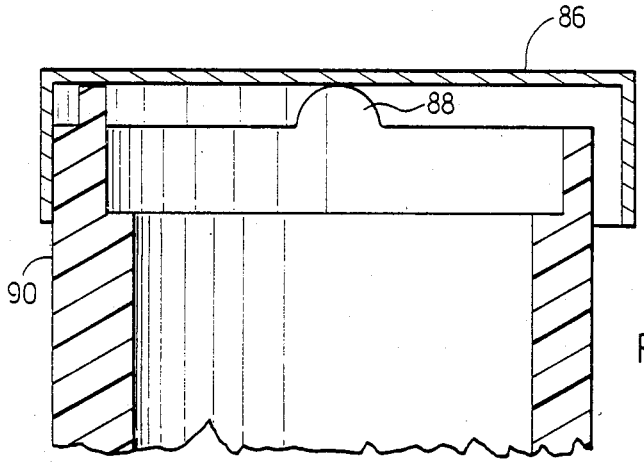
FIG. 6 is a cross-sectional view taken along the line 6—6 of FIG. 5 with the closure cap secured looking in the direction of the arrows.

Diaphragm 44 (See FIGS. 3 and 4) is stretched over annular wall 46 into trough 48 in base 22 and held therein by a gasket 49 (sealed therein by epoxy) for dividing the space between the shell 24 and base 22 into two compartments 50 and 52. Compartment 52 houses contacts 54 comprising stationary contact point 56 on the end of contact screw 57 supported by conical spring 57, and contact spring 58. Calibrated vent 60 (employing bushing screw 62 for calibration) fron compartment 50 to the back of base 22 permits predetermined amounts of air to pass therethrough under normal conditions of expansion and contraction of the air within compartment 50. Compartment 52 vents through aperture 64 surrounding contact screw 57. On the other side of base 22 are electrical contact screws 66 and 68, and opening 70 for vent 60 surrounded by annular wall 74. Central annular wall 82 surrounds aperture 64. Each of apertures 60 and 64 are covered by closure caps 86 best shown in FIGS. 5 and 6. Particularly, spacer projections 88, 1/32" (about 8/10 mm.) high are disposed on the top of annular walls 74 and 82 on which the caps seat respectively. Each cap 86 is slightly larger by the width of two of side projections 90 (3/32" (about 2 4/10 mm.) wide and 40/1000" (about 1 mm.) deep) to secure the cap over each projection to cover each well but to permit communication of the well with the ambient air.

Figure 8:
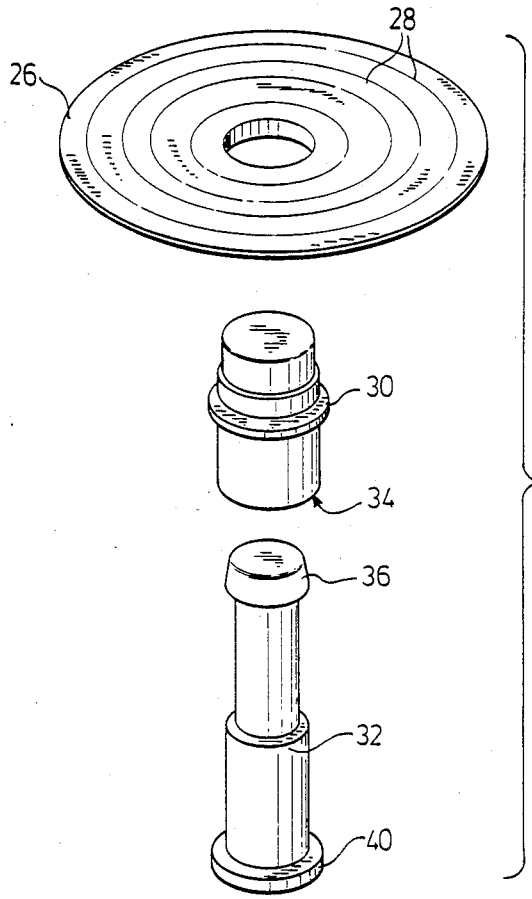
FIG. 8 is an exploded view of component parts of the detector of FIGS. 2 and 4.
Figure 7:
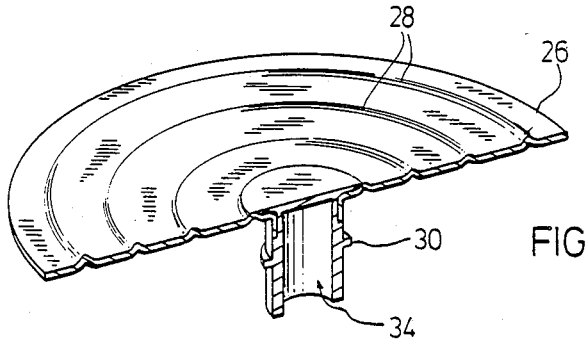
FIG. 7 is a cross-sectional view of the fin component of the detector shown in FIG. 2.
Figure 16:
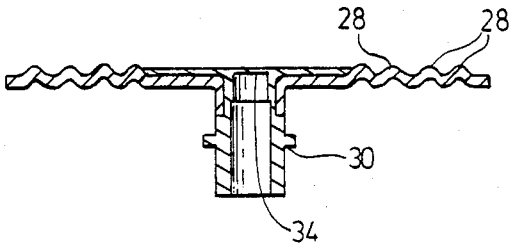
FIG. 16 (found with FIG. 10) is a schematic cross-sectional side view of the joint created by carrying out the operation shown in FIGS. 12 to 15 inclusive.
Figure 10:
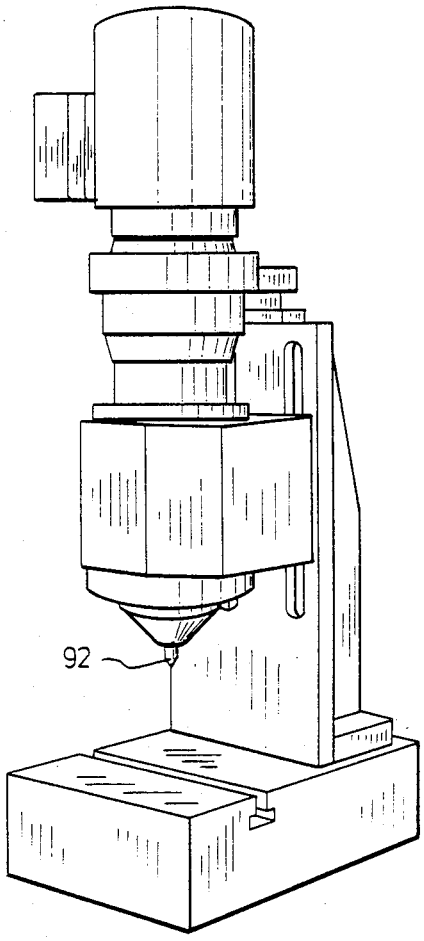
FIG. 10 is a perspective view of a Bracker Radial Riveting Machine Model RN002 for use according to the preferred embodiments of the invention.
Figure 11:
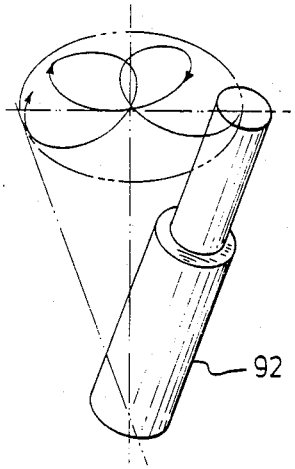
FIG. 11 is a schematic illustrating part of the operation of the machine shown in FIG. 10.
Figure 12:
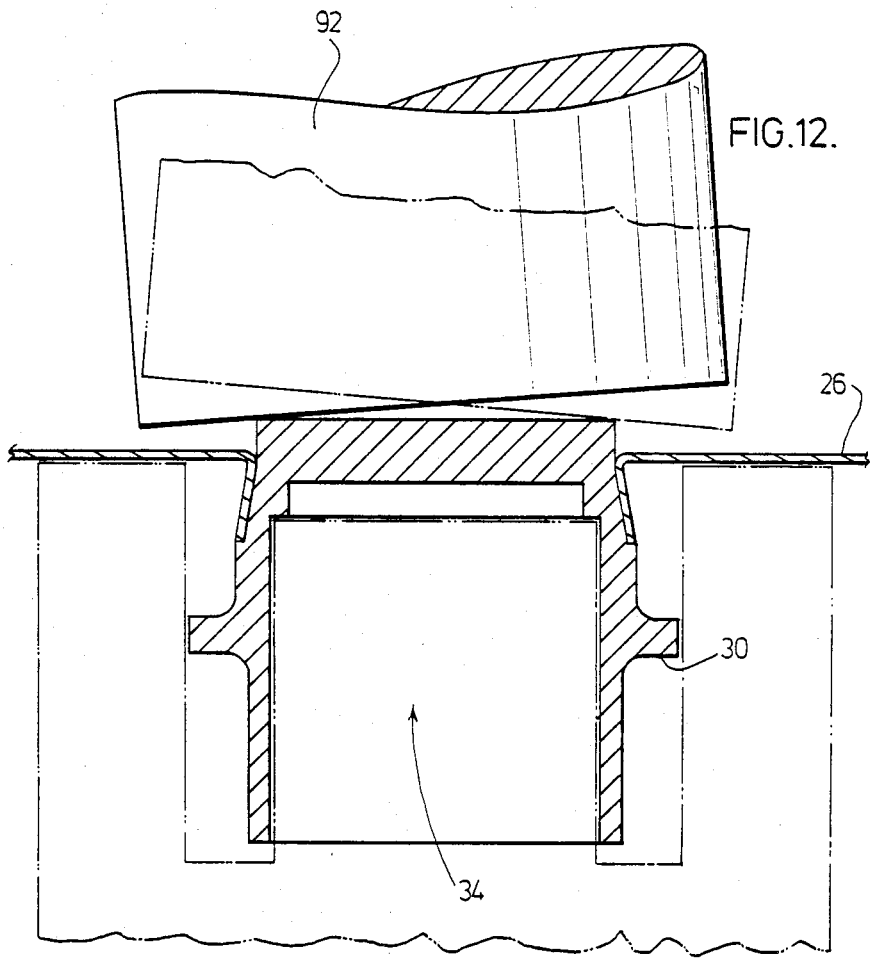
FIGS. 12 to 15 inclusive are cross-sectional views of the creation of the joint between a blind hole ferrule and fin according to the first preferred embodiment of the invention shown in at least FIGS. 1, 2, 3 and 4.
Figure 13:
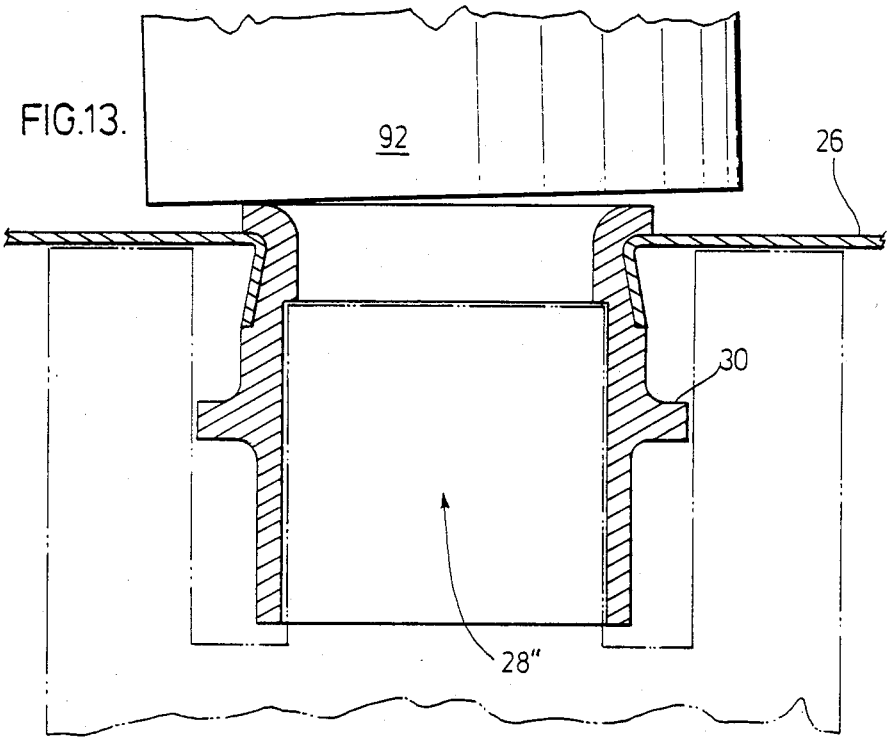
Figure 14:
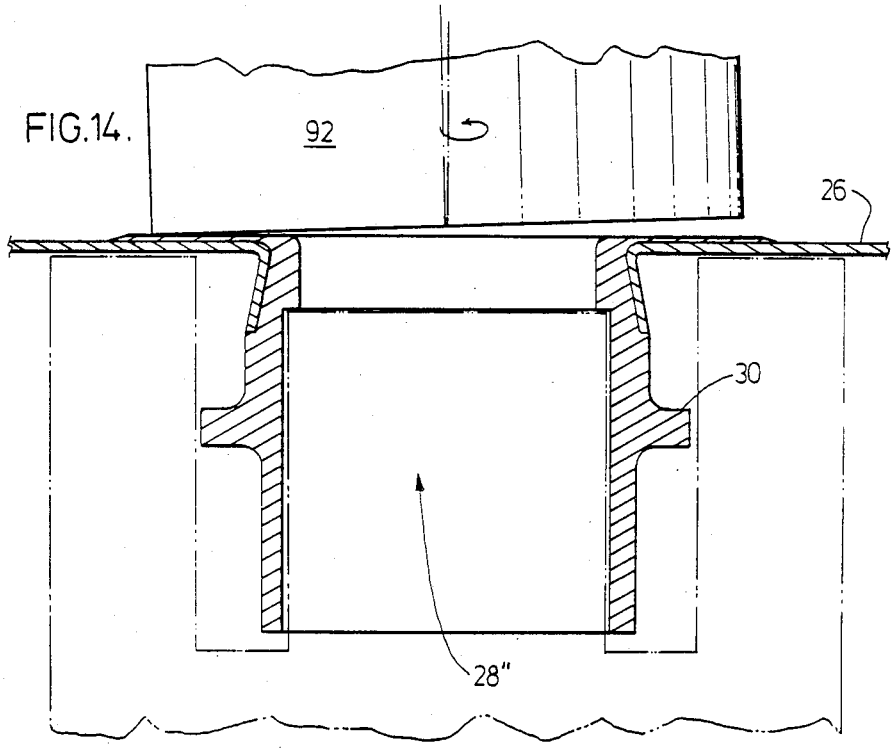
Figure 15:
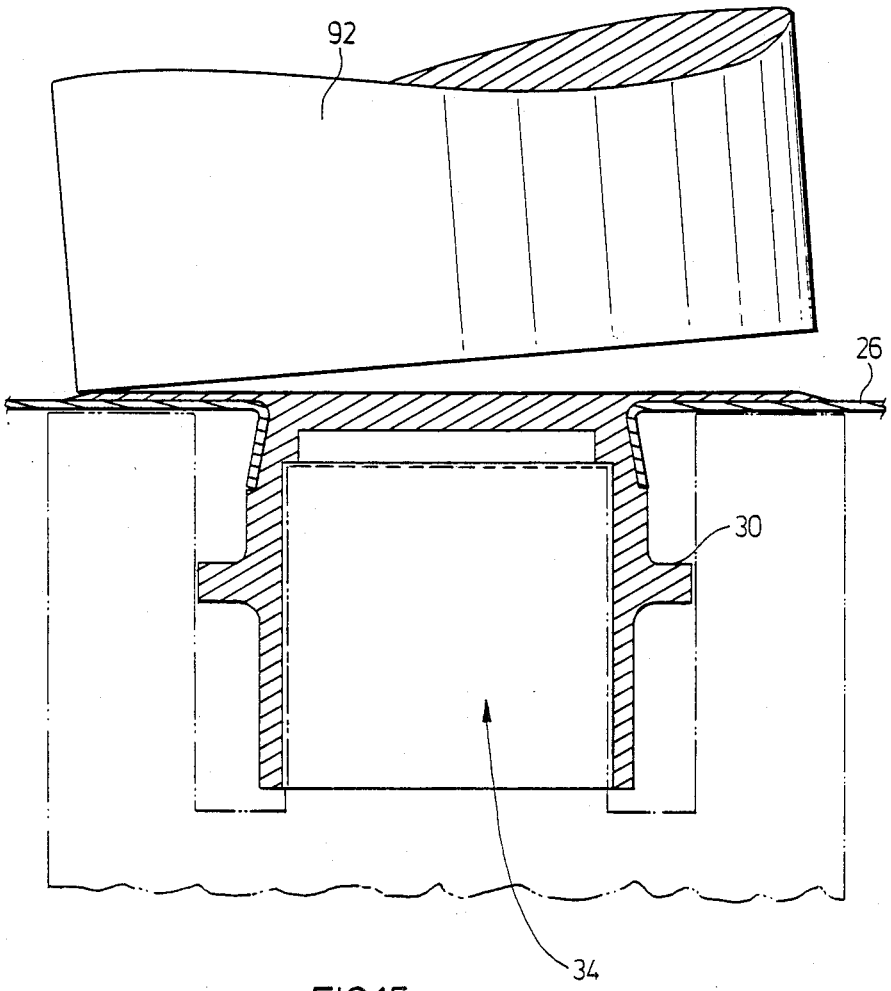

With reference to FIG. 7, fin 26 is married to blind hole tin plated aluminum ferrule 30 and is used to secure detente member 32 shown in FIG. 8. Because the ferrule is tin plated aluminum, it can be fused to the fusible link 36 of detente member 32. Fin 26 and ferrule 30 are married by the Bracker Radial Riveting Machine RN002 as shown in FIG. 10 supporting riveting peen 92 for marrying fin 26 and ferrule 30 as shown in FIGS. 13, 14 and 15 by a rolling action applied by flat face riveting peen 92 to the end of ferrule 30 to describe a series of loops that overlap tangentially at the center to give overall, a rosette pattern (See FIG. 11). Therefore, most of the force exerted by peen 92 is a rolling action (minimal axial force) causing the ferrule material to flow mainly in a radil direction (see FIGS. 13, 14 and 15) providing a rivet head substantially free from stress, and marrying the metals together. While not shown, ferrule 30 and fin 26 are supported against movement by a rigid support under or behind the area in contact with peen 92. The resultant union is shown in FIG. 16.

Figure 19:
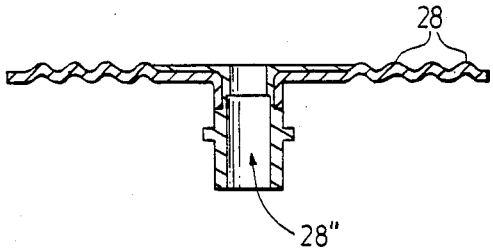
FIG. 19 (found with FIG. 10) is a schematic cross-sectional side view of the joint created by carrying out the operation shown in FIGS. 17 and 18.
Figure 9:
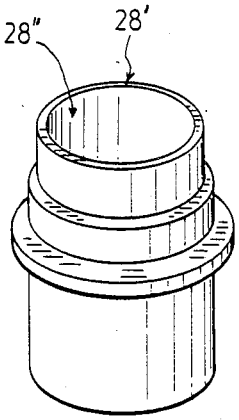
FIG. 9 is a perspective view of a ferrule having an aperture therethrough for use in another embodiment of the invention.
Figure 18:
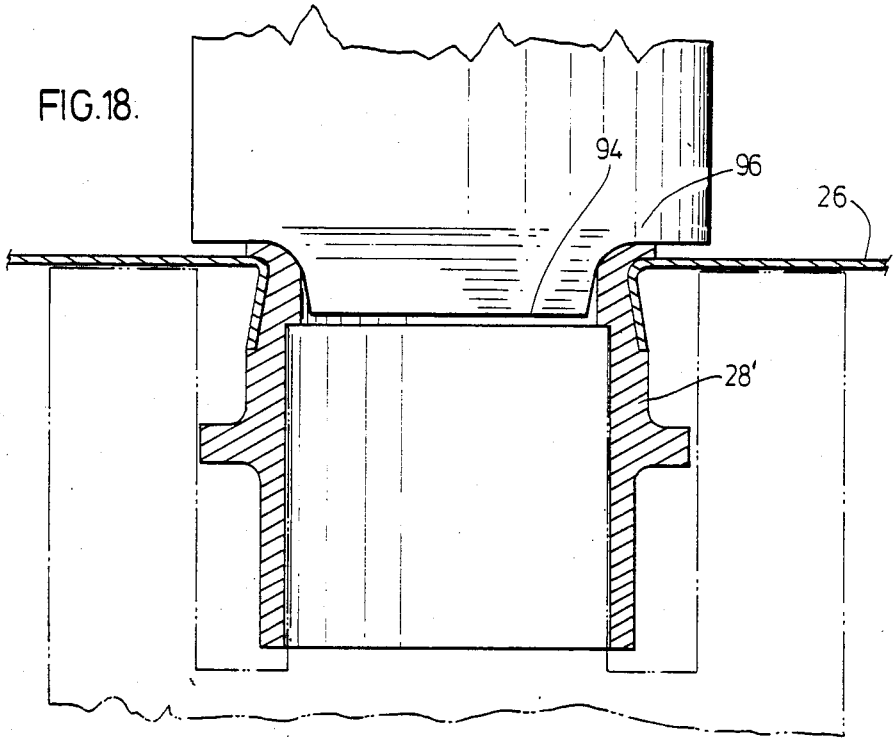
FIGS. 17 and 18 are cross-sectional views of the creation of the joint between an open ferrule shown in FIG. 9 and fin according to a second embodiment of the invention.
Figure 17:
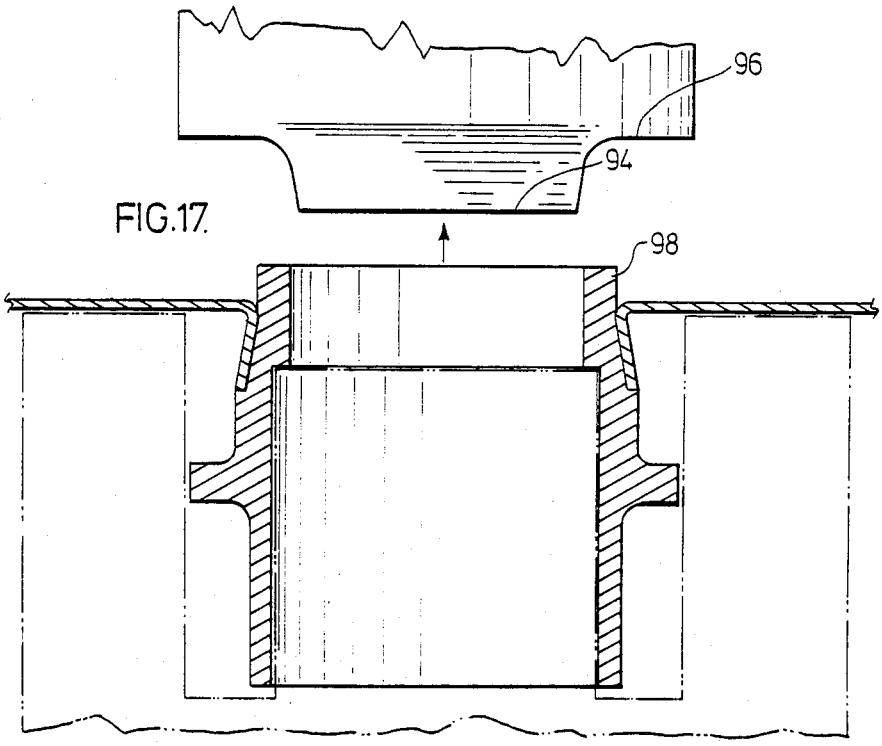

FIG. 9 illustrates an open hole ferrule $28^1$ having aperture $28^{11}$ therethrough and FIGS. 17, 18 and 19 illustrate the method of union. Once again fin 26 and ferrule $28^1$ are rigidly supported including the use of a mandrel inside open hole ferrule $28^1$. However, riveting peen 92 has a flat central portion 94 for projecting into aperture $28^{11}$ with ring annular stepped portion 96 spaced from, and surrounding, central portion 94 for rolling over top edge 98 of ferrule $28^1$ by the same motion to marry fin 26 to ferrule $28^1$ as shown in FIG. 19.

As many changes could be made to the invention without departing from the scope thereof, it is intended that all matter contained herein be interpreted as illustrative thereof and not in a limiting sense.

The embodiments of the invention in which an exclusive property or privilege is claimed are as follows:

1. An improved fire detector vented to atmosphere, capable of closing or opening an alarm circuit when the rate of rise of the temperature of the ambient atmosphere exceeds a predetermined prescribed rate of rise of temperature, comprising a base supporting a diaphragm, enclosing a space between the base and diaphragm, a shell secured to the base enclosing a space between the diaphragm and shell, electrical circuit contacts mounted on the base for being closed or opened when the actual rate of rise of the temperature in the space between the diaphragm and shell exceeds a predetermined rate of rise of temperature, vent apertures through the base from the spaces between the diaphragm and shell, and between the diaphragm and base to the back of the detector, the improvement comprising the vent apertures each being surrounded by an endless wall, the wall including relatively small projections on the top and relatively thin posts or lugs extending from the side, and a closure cap having a depending skirt, for seating on the small projections on the top of the wall and of an inner diameter to snugly seat the depending skirt of the closure cap against the outer surface of the posts or lugs to cover the vent aperture permitting the spaces between the diaphragm and base and shell and base to be vented to atmosphere under normal expansion and contraction of the ambient atmosphere in the fire detector without drawing substantial amounts of air from outside the cover and wall through the vent apertures.

2. The fire detector of claim 1, wherein the projections on top of the wall number at least three.

3. The fire detector of claim 2, wherein the posts or lugs number at least three.

4. The fire detector of claim 1 or 2, wherein the projections on the top of the wall extend about 1/32" (about 8/10 mm.) above the top of the wall.

5. The fire detector of claim 1, 2 or 3, wherein the posts or lugs project about 40/1000" (about 1 mm.) from the wall and are each about 3/32" (about 2 4/10 mm.) wide.

6. An improved fire detector having alarm actuating means for actuating an alarm at a predetermined temperature and a fin for collecting heat from the ambient atmosphere, the improvement comprising the fin being connected by a ferrule to the alarm actuating means for actuating an alarm at a predetermined temperature, the connection between the fin and ferrule having been formed by causing metal in an end portion of the ferrule to flow over fin metal surrounding the aperture of the fin through which aperture the ferrule extends, by supporting the ferrule to prevent the ferrule from collapsing under the forces applied to cause the ferrule metal to flow over the fin metal to provide a thin layer of ferrule metal over fin metal.

7. The improved fire detector fo claim 6, wherein the ferrule is a blind hole ferrule having an end closing the, ferrule having a concave face, the ferrule metal which has been caused to flow over the fin metal is from the concave face of the ferrule employing a riveting peen applied to the concave face to rotate around a circle to cause the concave face metal to flow radially outwardly over the fin metal adjacent the central aperture according to a circular path around the centre of the ferrule.

8. The improved fire detector of claim 6 wherein the ferrule is a blind hole ferrule having an end closing the ferrule having a concave face and the ferrule metal which has been caused to flow over the fin metal is the metal from the concave face of the ferrule employing a punch, or vertical press to force the ferrule metal radially outwardly.

9. The improved fire detector of claim 6, wherein the ferrule is open holed and is supported within the ferrule by a mandrel positioned in the ferrule and outside and the ferrule metal adjacent the aperture of the fin is swaged to cause the metal to flow radially over the fin adjacent the fin aperture.

10. An improved fire detector having alarm actuating means for actuating an alarm at a predetermined temperature, a fin for collecting heat from the ambient atmosphere, the improvement comprising the fin being connected by a ferrule to the alarm actuating means for actuating an alarm at a predetermined temperature the connection between the fin and ferrule having been formed by causing the metal in an end portion of the ferrule to flow over fin metal surrounding the aperture of the fin through which aperture the ferrule extends, by a rolling action of a riveting peen in a cycloidal motion describing a series of loops that overlap tangentially at the centre to give overall, a rosette pattern against the end portion of the ferrule to cause metal to flow radially outwardly into intimate contact with the fin metal adjacent the aperture to provide a thin layer of ferrule over fin metal.

11. The improved fire detector of claim 10, wherein the ferrule is a blind hole ferrule having an end closing the ferrule, the end having a face and the face is acted on by the riveting peen in the cycloidal motion to cause the metal to flow radially outwardly.

12. The fire detector of claim 11, wherein a Bracker Radial Riveting Machine is used to cause the rolling action of the riveting peen.

13. The fire detector of claim 11, wherein the fin comprises anodized aluminum and the ferrule comprises tin plated aluminum.

14. The fire detector of claim 10, 11 or 13, wherein the fin is corrugated.

15. The fire detector of claim 10, 11 or 13, wherein the fin is corrugated by concentric annular ridges.

16. The improved fire detector vented to atmosphere, capable of closing or opening an alarm circuit on the happening of either of two events, when the rate of rise of the temperature of the ambient atmosphere exceeds a predetermined prescribed rate of rise of temperature and when the temperature of the ambient atmosphere exceeds a predetermined fixed temperature, the detector comprising a base supporting a diaphragm enclosing a space between the base and diaphragm, a shell secured to the base enclosing the diaphragm, electrical circuit contacts mounted on the base for being closed or opened when the actual rate of rise of the temperature in the space between the diaphragm and shell exceeds a predetermined rate of rise of temperature, vent apertures through the base from the spaces between the diaphragm and shell, and between the diaphragm and base, to the back of the detector, and a fin for collecting heat from the ambient atmosphere, the improvement comprising:

the vent apertures each being surrounded by an endless wall, the wall including relatively small projections on the top and relatively thin posts or lugs extending from the side and a closure cap having a depending skirt for seating on the small projections on the top of the wall and of an inner diameter to snugly seat the depending skirt of the closure cap against the outer surface of the posts or lugs to cover the vent aperture permitting the spaces between the diaphragm and base, and shell and base to be vented to atmosphere under normal expansion and contraction of the ambient atmosphere in the fire detector without drawing substantial amounts of air from outside the cover and wall through the vent apertures;

the fin being connected by a blind hole ferrule being closed by an end face, to alarm actuating means for actuating an alarm at a predetermined temperature, the connection between the fin and ferrule having been formed by causing metal from the end face of the ferrule to flow over fin metal surrounding the aperture of the fin through which aperture the ferrule extends, by a rolling action of a riveting peen in a cycloidal motion describing a series of loops that overlap tangentially at the center to give overall, a rosette pattern against the end face of the ferrule to cause the metal to flow radially outwardly into intimate contact with the fin metal adjacent the aperture to provide a thin layer of ferrule metal over fin metal.

17. The fire detector of claim 16, wherein the projections on the top of the wall number at least three.

18. The fire detector of claim 17, wherein the posts or lugs number at least three.

19. The fire detector of claim 16, wherein the projections on the top of the wall extend about 1/32" (about 8/10 mm.) above the top of the wall.

20. The fire detector of claim 17 or 19, wherein the posts or lugs project about 40/1000" (about 1 mm.) from the wall and are each about 3/32" (about 2 4/10 mm.) wide.

21. The fire detector of claim 16, wherein a Bracker Radial Riveting Machine is used to cause the rolling action of the riveting peen.

22. The fire detector of claim 16, wherein the fin comprises anodized aluminum and the ferrule comprises tin plated aluminum.

23. The fire detector of claim 16, 21 or 22 wherein the fin is corrugated.

24. The fire detector of claim 16, 21 or 22, wherein the fin is corrugated by concentric annular ridges.

25. An improved fire detector vented to atmosphere, capable of closing or opening an alarm circuit when the rate of rise of the temperature of the ambient atmosphere exceeds a predetermined prescribed rate of rise of temperature, comprising a base supporting a diaphragm, enclosing a space between the base and diaphragm, a shell secured to the base enclosing a space between the diaphragm and shell, electrical circuit contacts mounted on the base for being closed or opened when the actual rate of rise of the temperature in the space between the diaphragm and shell exceeds a predetermined rate of rise of temperature, vent apertures through the base from the spaces between the diaphragm and shell, and between the diaphragm and base to the back of the detector, the improvement comprising vent apertures each being surrounded by an endless wall, covered by a closure cap having a top and depending skirt, small projections disposed between the top of the closure cap and the top of the endless wall and thin posts or lugs between the endless wall and depending skirt for spacing the top of the wall from the top of the closure cap and spacing the endless wall from the depending skirt to cover the vent aperture permitting the spaces between the diaphragm and base and shell and base to be vented to atmosphere under normal expansion and contraction of the ambient atmosphere in the fire detector without drawing substantial amounts of air from outside the cover and wall through the vent apertures.

26. The fire detector of claim 25, wherein the projections between the top of the endless wall and top of the closure cap number at least three.

27. The fire detector of claim 26, wherein the posts or lugs number at least three.

28. The fire detector of claim 25 or 16, wherein the projections extend about 1/32" (about 8/10 mm.) above the top of the wall.

29. The fire detector of claim 25, 26 or 27, wherein the posts or lugs project about 40/1000" (about 1 mm.) from the wall and are each about 3/32" wide (about 2 4/10 mm.).

* * * * *